US005330704A

United States Patent [19]

Gilman

[11] Patent Number: 5,330,704

[45] Date of Patent: Jul. 19, 1994

[54] METHOD FOR PRODUCING ALUMINUM POWDER ALLOY PRODUCTS HAVING LOWER GAS CONTENTS

[75] Inventor: Paul S. Gilman, Suffern, N.Y.

[73] Assignee: AlliedSignal Inc., Morristown, N.J.

[21] Appl. No.: 650,122

[22] Filed: Feb. 4, 1991

[51] Int. Cl.[5] ..... B22F 3/16

[52] U.S. Cl. ..... 419/60; 419/39

[58] Field of Search ..... 419/28, 60, 39; 75/950

[56] References Cited

U.S. PATENT DOCUMENTS

| | | | |
|---|---|---|---|
| 2,963,780 | 12/1960 | Lyle et al. | 75/249 |
| 2,967,351 | 1/1961 | Roberts et al. | 419/38 |
| 3,462,248 | 8/1969 | Roberts et al. | 75/249 |
| 3,954,458 | 5/1976 | Roberts | 75/200 |
| 4,069,042 | 1/1978 | Buchovecky et al. | 75/208 R |
| 4,347,076 | 8/1982 | Ray et al. | 75/255 |
| 4,379,719 | 4/1983 | Hildeman et al. | 419/60 |
| 4,643,780 | 2/1987 | Gilman et al. | 148/12.7 A |
| 4,647,321 | 3/1987 | Adam | 148/415 |
| 4,702,855 | 10/1987 | Odani et al. | 419/23 |
| 4,722,754 | 2/1988 | Ghosh et al. | 148/11.5 A |
| 4,729,790 | 3/1988 | Skinner | 75/249 |
| 4,762,679 | 8/1988 | Gegel et al. | 419/28 |
| 4,770,848 | 9/1988 | Ghosh et al. | 419/28 |
| 4,869,751 | 9/1989 | Zedalis et al. | 75/249 |
| 4,878,967 | 11/1989 | Adam et al. | 148/437 |
| 5,015,440 | 5/1991 | Bowden | 419/31 |

OTHER PUBLICATIONS

Guinn E. Metzger, "Gas Tungsten Arc Welding of Al-10Fe-5Ce", report No. AFWAL-TR-87-4037, AFWAL/MLLS, Wright-Patterson AFB, OH 45433, Feb. 1987.

*Primary Examiner*—Donald P. Walsh
*Assistant Examiner*—Daniel Jenkins
*Attorney, Agent, or Firm*—Ernest D. Buff; Roger H. Criss

[57] ABSTRACT

Powder composed of particles of a rapidly solidified dispersion strengthened aluminum base alloy is compacted into billet form. The billet is vacuum autoclaved at a temperature ranging from 350° C. to the alloy's incipient melting temperature and formed into a substantially fully dense wrought product. Gas content of the alloy is decreased and powder degassing steps are eliminated. The dispersion strengthened aluminum wrought product is produced in an economical and efficient manner.

15 Claims, 2 Drawing Sheets

METHOD FOR PRODUCING ALUMINUM POWDER ALLOY PRODUCTS HAVING LOWER GAS CONTENTS

BACKGROUND OF THE INVENTION

1. Field of the Invention

The present invention relates to dispersion strengthened aluminum-base alloys, and more particularly to a method for reducing the gas content of an extruded, forged or rolled aluminum powder metallurgy product.

2. Description of the Prior Art

In recent years the aerospace industry has searched for high temperature aluminum alloys to replace titanium and existing aluminum alloys in applications requiring operating temperatures approaching 350° C. While high strength at ambient and elevated temperatures is a primary requirement, certain design applications mandate that candidate alloys also exhibit, in combination, ductility, toughness, fatigue and corrosion resistance, as well as lower density than the materials currently being used.

One of the major restrictions to the widespread utilization of high temperature aluminum alloys is their inability to be welded or brazed. The application of standard welding and brazing practices to these high performance aluminum alloys results in the formation of excessive porosity in the weld and heat affected zone of the joint due to the outgassing of the alloy during the joining cycle and the coalescence of the gases to form porosity. The excessive gas porosity, is caused in part by the presence of hydrogen, as hydroxide or water, in the base metal. Also the slow cooling of the welded area may favor the formation of coarse, brittle intermetallics which will severely reduce the joint strength and ductility when compared to the base metal. Finally, any treatment given to these alloys to improve their weldability must be cost effective.

The hydrogen content may be reduced by heat treatment of the high temperature aluminum alloy in vacuum at high temperature. However, the heat treatment is limited by the reduction of the base metal strength as the heat treating time and temperature increases. Previous disclosures have shown that the weld porosity in powder metallurgy aluminum alloys (Al-10Fe-5Ce) can be virtually eliminated by a combination of preweld vacuum heat treatment, i.e. 750° F. for 24 hrs. in vacuum, and direct current electrode negative welding, with only a minor decrease in base metal tensile strength, the welds exhibit a brittle behavior due to brittle phases formed near the weld interface. These welds are restricted to non-structural applications. (Gas Tungsten Arc Welding of Al-10Fe-5Ce, Guinn Metzger, report No. AFWAL-TR-87-4037, AFWAL/MLLS, Wright-Patterson AFB, Ohio 45433, February 1987).

To date, the majority of aluminum base alloys being considered for elevated temperature applications are produced by rapid solidification. Such processes typically produce homogeneous materials, and permit control of chemical composition by providing for incorporation of strengthening dispersoids into the alloy at sizes and volume fractions unattainable by conventional ingot metallurgy. Processes for producing chemical compositions of aluminum base alloys for elevated temperature applications have been described in U.S. Pat. No. 2,963,780 to Lyle et al., U.S. Pat. No. 2,967,351 to Roberts et al., U.S. Pat. No. 3,462,248 to Roberts et al., U.S. Pat. No. 4,379,719 to Hildeman et al., U.S. Pat. No. 4,347,076 to Ray et al., U.S. Pat. No. 4,647,321 to Adam et al. and U.S. Pat. No. 4,729,790 to Skinner et al. The alloys taught by Lyle et al., Roberts et al. and Hildeman et al. were produced by atomizing liquid metals into finely divided droplets by high velocity gas streams. The droplets were cooled by convective cooling at a rate of approximately $10^4$° C./sec. Alternatively, the alloys taught by Adam et al., Ray et al. and Skinner et al. were produced by ejecting and solidifying a liquid metal stream onto a rapidly moving substrate. The produced ribbon is cooled by conductive cooling at rates in the range of $10^5$ to $10^7$° C./sec. In general, the cooling rates achievable by both atomization and melt spinning greatly reduce the size of intermetallic dispersoids formed during the solidification. Furthermore, engineering alloys containing substantially higher quantities of transition elements are able to be produced by rapid solidification with mechanical properties superior to those previously produced by conventional solidification processes.

The need remains in the art for a process for reducing the gas contents of rapidly solidified, dispersion strengthened aluminum base alloys while retaining useful mechanical properties after welding or brazing.

SUMMARY OF THE INVENTION

The present invention provides a process for reducing the gas content of a dispersion strengthened aluminum base alloy. The gas contents of the resulting material may be such that compacting under vacuum is not necessary and/or the gas contents are reduced for the purpose of improving the welding and/or brazing of the alloy while minimizing the reduction in mechanical properties of the alloy due to the joining process.

In one aspect, the present invention provides a process for producing wrought product comprising the steps of:

a. compacting a powder composed of particles produced by rapid solidification of said alloy to obtain a compacted billet having a density ranging from 70% to 98% of the theoretical density of said alloy;

b. vacuum autoclaving said compacted billet at a temperature ranging from 350° C. to the incipient melting point of the alloy; and c. forming said billet into a substantially fully dense wrought product, preferably, the forming step is selected from the group consisting of extrusion, forging and rolling. The compacting step is optionally carried out in the absence of a vacuum.

In general, the products obtained by the process of the invention exhibit excellent mechanical properties, including high strength and ductility at ambient as well as elevated temperatures. Together with its reduced gas content such properties make the wrought product especially suited for joining by welding or brazing. Advantageously, the products produced by the process of the invention are substantially defect free. Any porosity extant during vacuum autoclaving of the porous compacted billet is removed during fabrication thereof to a wrought product.

Alloys preferred for use in the process of our invention are those high temperature aluminum alloys disclosed in U.S. Pat. No. 4,878,967. Conversion of vacuum autoclaved billets into wrought product is accomplished by the process disclosed in U.S. Pat. No. 4,869,751.

The present process utilizes the existing porosity in the compacted billet to aid outgassing. Since the compacted billet has some degree of porosity the vacuum outgassing is more efficient than conventional processes for outgassing the wrought product. The utilization of the residual porosity permits the alloys to be degassed at lower temperatures and shorter times, or optimized combinations of temperature or time, that are not available with processes for outgassing a wrought product. This flexibility allows degassing conditions to be selected that will significantly reduce the gas levels while minimizing any reduction in mechanical properties due to the outgassing treatment. Moreover, any porosity formed during the outgassing step is removed with the residual porosity in the as compacted billet. Porosity formed during degassing of a wrought product is conventionally retained, adversely affecting the mechanical properties thereof. Consequently, the temperature and time window for vacuum degassing the consolidated billet is much bigger than that allowed for degassing the wrought product.

The present invention provides a method wherein wrought dispersion strengthened aluminum products are fabricated in a highly efficient and economical manner, and time consuming and costly powder degassing steps are eliminated.

BRIEF DESCRIPTION OF THE DRAWINGS

The invention will be more fully understood and further advantages will become apparent when reference is made to the following detailed description of the preferred embodiments of the invention and the accompanying drawings, in which.

DESCRIPTION OF THE PREFERRED EMBODIMENTS

Figure 1:
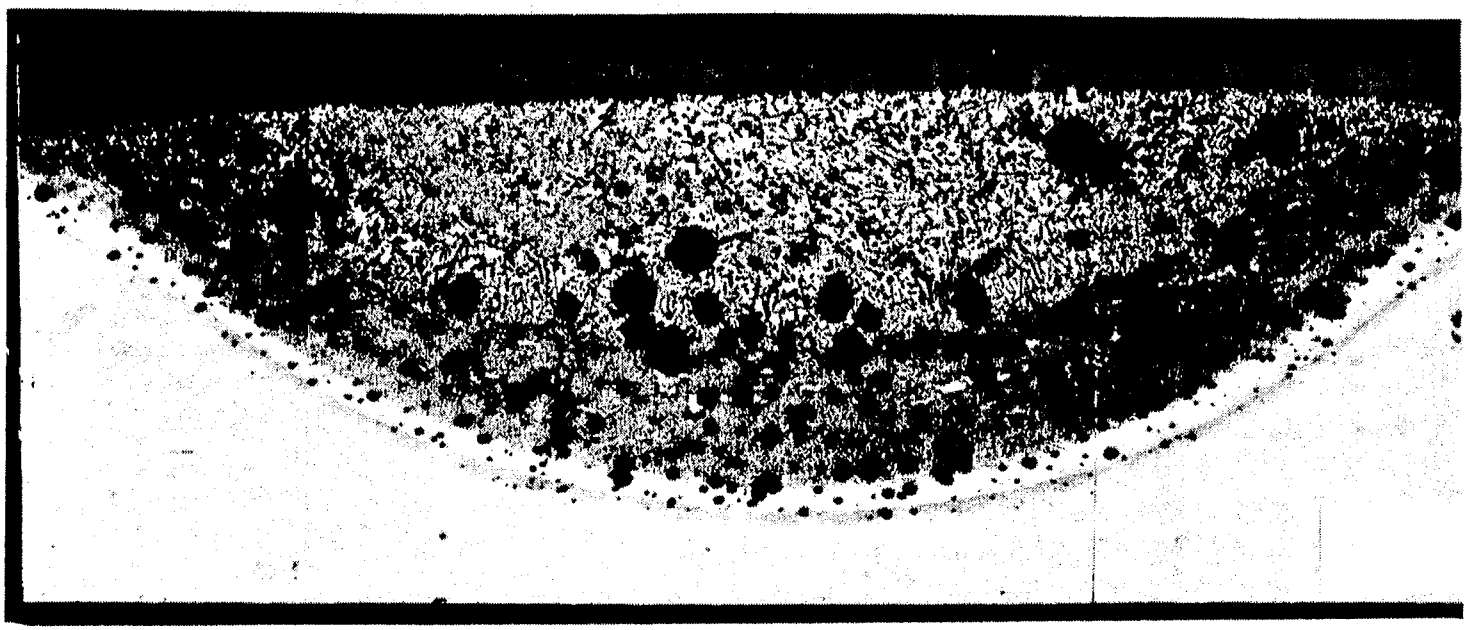
FIG. 1 is a photomicrograph of the cross-section of an autogenous weld across an aluminum-iron-vanadium-silicon alloy extrusion that has not been outgassed in accordance with the invention.

The present invention provides a process for reducing the gas content of a dispersion strengthened aluminum base alloy comprising the steps of compacting under vacuum a powder composed of particles produced by rapid solidification of said alloy to obtain a compacted billet having sufficient density to be formed into a substantially dense wrought product, vacuum autoclaving said compacted billet at temperatures ranging from 350° C. to the incipient melting point of the alloy; and forming said billet into a substantially fully dense wrought product. Preferably, the forming step is selected from the group consisting of extrusion, forging and rolling. Compaction of the alloy is carried out at least to the extent that the porosity is isolated, and ranges from 70% to 98% of full density.

In a preferred embodiment of the present invention, vacuum autoclaving takes place between 400° C. to 500° C. in order to minimize any microstructural changes in the alloy due to the high temperature degassing treatment. Optimum properties in the vacuum autoclaved alloy are obtained when fabrication of the wrought product is carried out in accordance with the method taught in U.S. Pat. No. 4,864,751, the disclosure of which is incorporated herein by reference thereto.

In a preferred embodiment, alloys in the present invention involve rapidly solidified aluminum alloys described in U.S. Pat. No. 4,879,967, which alloys consist essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio [Fe+X]:Si ranges from about 2.0:1 to 5.0:1.

Another aluminum base, rapidly solidified alloy suitable for use in the process of the invention has a composition consisting essentially of the formula $Al_{bal}Fe_aSi_bX_c$ wherein X is at least one element selected from the group consisting of Mn, V, Cr, Mo, W, Nb, Ta, "a" ranges from 1.5 to 7.5 at %, "b" ranges from 0.75 to 9.0 at %, "c" ranges from 0.25 to 4.5 at % and the balance is aluminum plus incidental impurities, with the proviso that the ratio [Fe+X]:Si ranges from about 2.01:1 to 1.0:1.

Still another aluminum base, rapidly solidified alloy that is suitable for use in the process of the invention has a composition range consisting essentially of about 2–15 at % from a group consisting of zirconium, hafnium, titanium, vanadium, niobium, tantalum, erbium, about 0.5 at % calcium, about 0–5 at % germanium, about 0–2 at boron, the balance being aluminum plus incidental impurities.

A low density aluminum-lithium base, rapidly solidified alloy suitable for use in the present process has a composition consisting essentially of the formula $Al_{bal}Zr_aLi_bMg_cT_d$, wherein T is at least one element selected from the group consisting of Cu, Si, Sc, Ti, B, Hf, Be, Cr, Mn, Fe, Co and Ni, "a" ranges from about 0.05–0.75 at %, "b" ranges from about 9.0–17.75 at %, "c" ranges from about 0.45–8.5 at % and "d" ranges from about 0.05–13 at %, the balance being aluminum plus incidental impurities.

The aluminum base, rapidly solidified alloys mentioned above may also be combined with a reinforcing phase to form a metal matrix composite. Also, the present invention is not limited to single types of reinforcements or single phase matrix alloys but can comprise a plurality of types of reinforcing particles, or a plurality of phases of matrix alloys.

To provide the desired levels of strength, toughness and ductility needed for commercially useful applications, the alloys of the invention were rapidly solidified at cooling rates sufficient to greatly reduce the size of the intermetallic dispersoids formed during the solidification as well as allow for substantially higher quantities of transition elements to be added than possible by conventional solidification processes. The rapid solidification process is one wherein the alloy is placed into a molten state and then cooled at a quench rate of at least about $10^5$ to $10^7$° C./sec to form a solid substance. Preferably this method should cool the molten metal at a rate of greater than about $10^6$° C./sec, i.e., via melt spinning, splat cooling or planar flow casting, which forms a solid ribbon. These alloys have an as-cast microstructure which varies from a microeutectic to a microcellular structure, depending on the specific alloy chemistry. In the present invention, the relative proportions of these structures are not critical.

Ribbons of said alloy are formed into particles by conventional comminution devices such as a pulverizer, knife mills, rotating hammer mills and the like. Preferably, the comminuted powder particles have a size ranging from about −40 mesh to about −200 mesh, U.S. standard sieve size.

The particles may then be canless vacuum hot pressed at a temperature ranging from about 275° C. to 550°C., preferably ranging from about 300° C. to 500° C., in a vacuum less than $10^{-4}$ torr ($1.33\times10^{-2}$ Pa), preferably less than $10^{-5}$ torr ($1.33\times10^{-2}$ Pa), and then compacted in a blind die. Those skilled in the art will appreciate that compaction may also be performed by placing the comminuted powder in metal cans, such as aluminum cans having a diameter as large as 30 cm or more, hot degassed in the can under the aforementioned conditions, sealed therein under vacuum, and then thereafter re-heated within the can and compacted to near full density, the compacting step being conducted, for example, in a blind die extrusion press. In general, any technique applicable to the art of powder metallurgy which does not invoke liquefying (melting) or partially liquefying (sintering) the matrix metal can be used.

Representative of such techniques are explosive compaction, cold isostatic pressing, hot isostatic pressing and conforming.

In conversions from ° F. to ° C., the temperatures were rounded off, as were the conversions from ksi to MPa and inches to centimeters. Also, alloy compositions disclosed herein are nominal. With respect to conditions, for commercial production it is not practical or realistic to impose or require conditions extant in a research laboratory facility. Temperatures may vary, for example, by 25° C. of the target temperature disclosed herein. Thus, having a wider window for processing conditions adds to the practical value of the process.

This invention is further described herein, but is not limited by the examples given below. In all examples the test samples were fabricated from dispersion strengthened alloys comprising aluminum, iron, vanadium and silicon in the concentrations defined in U.S. Pat. No. 4,878,967, and prepared from rapidly solidified powders by the compaction and fabrication techniques described above. The specific techniques, conditions, materials, proportions and reported data set forth to illustrate the principles of the invention are exemplary and should not be construed as limiting the scope of the invention.

EXAMPLE I

One hundred and sixty pounds of −40 mesh (U.S. standard sieve) powder of the nominal composition aluminum-balance, 4.33 at. % iron, 0.73 at. % vanadium, 1.72 at. % silicon (hereinafter designated alloy 8009 was produced by comminuting rapidly solidified planar flow cast ribbon. The powder was then vacuum degassed at $2\times10^{-4}$ torr until the powder reached 350° C. The vacuum degassed powder was then vacuum compacted into a 11" diameter billet at 380° C. at $1.4\times10^{-4}$ torr to a final density of 95.8%. From the 11" diameter vacuum hot pressed billet two 4.3" diameter x 14" high billets were machined. The 4.3" diameter billets were labeled A and B. Billet A was subsequently autoclaved at 500° C. in a vacuum of $5.5\times10^{-6}$ for 24 hours. Billets A and B were heated to a temperature of about 385° C. and extruded through tool steel dies heated to a temperature of about 300° C. to form 0.95 cm×5.6 cm flat bars. The oxygen and hydrogen contents of extruded billets A and B were measured by vacuum fusion and are set forth in Table 1.

TABLE 1

| Billet | % $O_2$ | Gas Contents of Billets: Surface $H_2$ (ppm) | Bulk $H_2$ (ppm) | Total $H_2$ (ppm) |
|---|---|---|---|---|
| A | 0.100 | 0.088 | 0.620 | 0.710 |
| B | 0.100 | 0.114 | 2.630 | 2.750 |

As shown by the data set forth in Table 1, the hydrogen content of the vacuum autoclaved material is approximately one-fourth that of the control billet.

EXAMPLE II

Figure 2:
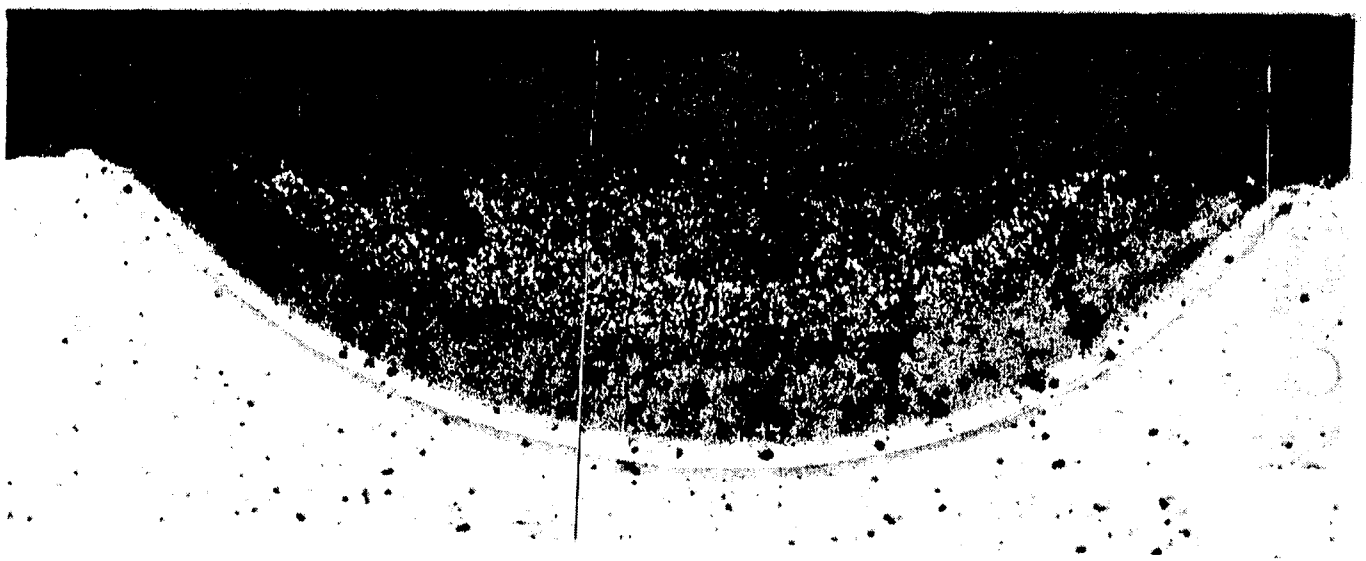
FIG. 2 is a photomicrograph of the cross-section of an autogenous weld across an aluminum-iron-vanadium-silicon alloy extrusion that has been outgassed in accordance with the invention, showing the substantial reduction in weld porosity.

Autogenous tungsten arc - inert gas welds were run across the extrusion of billets A and B from Example I. The welds were cross sectioned and photographed. Photomicrographs of the weld cross sections, shown in FIGS. 1 and 2, depict the reduction in porosity of the weld cross section of billet A.

EXAMPLE III

The tensile properties of the extrusions made from billets A and B, as described in Example I, were measured and are listed in Table 2 below.

TABLE 2

| Billet I.D. | Orientation | YS MPa | TS MPa | El. to Failure Percent | Red. in Area Percent |
|---|---|---|---|---|---|
| A | Longitudinal | 366 | 456 | 15.0 | 49.6 |
| | Transverse | 431 | 534 | 12.5 | 34.5 |
| B | Longitudinal | 436 | 506 | 16.0 | 54.2 |
| | Transverse | 483 | 572 | 7.1 | 28.6 |
| Percent Change After Vacuum Autoclaving (From B to A) | Longitudinal | −16% | −9.8% | −6.3% | −8.4% |
| | Transverse | −10.7% | −6.5% | 76% | 20% |

The tensile properties of the extrusion from billet A are only slightly reduced compared to those of the extrusion from billet B. Also, the ductilities are more homogeneous after the vacuum autoclaving. This indicates that the vacuum autoclaving treatment given to billet A reduced its gas content, but did not significantly alter the tensile properties of the extrusion. A more judicious selection of the vacuum autoclaving temperature and time parameters should reduce the gas content of the alloy without affecting the strength of the material.

Having thus described the invention in rather full detail, it will be understood that such detail need not be strictly adhered to but that various changes and modifications may suggest themselves to one skilled in the art, all falling within the scope of the invention as defined by the subjoined claims.

What is claimed:

1. A process for reducing the gas content of a dispersion strengthened aluminum base alloy, comprising the steps of:

(a) compacting a powder Composed of particles produced by rapid solidification of said alloy to obtain a compacted billet having a density varying from 70% to 98% of full density;

(b) vacuum autoclaving said compacted billet at a temperatures ranging from 350° C. to the alloy's incipient melting point;

(c) forming said billet into a substantially fully dense wrought product.

2. A process as recited by claim 1, wherein said compacting step is carried out under vacuum.

3. A process as recited by claim 1, wherein said forming step is an extrusion step.

4. A process as recited by claim 1, wherein said forming step is a forging step.

5. A process as recited by claim 1, wherein said forming step is a rolling step.

6. A process as recited by claim 1, wherein said vacuum autoclaving is carried out at a temperature ranging from 400° C. to 500° C.

7. A process as recited by claim 1, wherein said aluminum base alloy has a composition consisting essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio [Fe+X]:Si ranges from about 2.0:1 to 5.0:1.

8. A process as recited by claim 1, wherein said aluminum base alloy has a composition consisting essentially of 4.33 atom percent iron, 0.73 atom percent vanadium, 1.72 atom percent silicon, the balance being aluminum.

9. A process as recited by claim 1, wherein said rapidly solidified aluminum base alloy is selected from the group consisting of the elements Al-Fe-V-Si, wherein the iron ranges from about 1.5–8.5 at %, vanadium ranges from about 0.25–4.25 at %, and silicon ranges from about 0.5–5.5 at %.

10. A process as recited by claim 1, wherein said rapidly solidified aluminum base alloy has a composition consisting essentially of the formula $Al_{bal}Fe_aSi_bX_c$, wherein X is at least one element selected from the group consisting of Mn, V, Cr, Mo, W, Nb, Ta, "a" ranges from 2.5 to 7.5 at %, "b" ranges from 0.75 to 9.0 at %, "c" ranges from 0.25 to 4.5 at % and the balance is aluminum plus incidental impurities, with the proviso that the ratio [Fe+X]:Si ranges from about 2.0:1 to 1.0:1.

11. A process as recited by claim 1, wherein said rapidly solidified aluminum base alloy has a composition consisting essentially of about 2–15 at % from a group consisting of zirconium, hafnium, titanium, vanadium, niobium, tantalum, erbium, about 0–5 at % calcium, about 0–5 at % germanium, about 0–2 at % boron, the balance being aluminum plus incidental impurities.

12. A process as recited by claim 2, wherein said rapidly solidified aluminum base alloy is selected from the group consisting essentially of the formula $Al_{bal}Zr_aLi_bMg_cT_d$, wherein T is at least one element selected from the group consisting of Cu, Si, Sc, Ti, B, Hf, Be, Cr, Mn, Fe, Co and Ni, "a" ranges from about 0.05–0.75 at %, "b" ranges from about 9.0–17.75 at %, "c" ranges from about 0.45–8.5 at % and "d" ranges from about 0.05–13 at %, the balance being aluminum plus incidental impurities.

13. A process as recited by claim 1, wherein said rapidly solidified aluminum alloy has combined therewith a reinforcing phase, forming a metal matrix composite.

14. A process as recited by claim 13, wherein said reinforcing phase comprises a plurality of phases of matrix alloys.

15. A process as recited by claim 13, wherein said reinforcing phase comprises a plurality of types of reinforcing particles.

* * * * *